US005382934A

United States Patent [19]

Hendel et al.

[11] Patent Number: 5,382,934

[45] Date of Patent: Jan. 17, 1995

[54] ELECTROMAGNETIC CHANGEOVER RELAY

[75] Inventors: Horst Hendel; Josef Kern; Bernhard Kleine-Onnebrink, all of Berlin, Germany

[73] Assignee: Siemens Aktiengesellschaft, Munich, Germany

[21] Appl. No.: 178,282

[22] PCT Filed: Jul. 7, 1992

[86] PCT No.: PCT/EP92/01529

§ 371 Date: Jan. 10, 1994

§ 102(e) Date: Jan. 10, 1994

[87] PCT Pub. No.: WO93/01609

PCT Pub. Date: Jan. 21, 1993

[30] Foreign Application Priority Data

| | | | |
|---|---|---|---|
| Jul. 9, 1991 | [DE] | Germany | 91111423 |
| Jun. 17, 1992 | [DE] | Germany | 4219933 |
| Jun. 24, 1992 | [DE] | Germany | 9208452[U] |

[51] Int. Cl.[6] ..... H01H 9/00

[52] U.S. Cl. ..... 335/159; 335/256; 335/78

[58] Field of Search ..... 335/159, 160, 161, 78–86, 335/128, 124, 131, 202, 256

[56] References Cited

U.S. PATENT DOCUMENTS

| | | | |
|---|---|---|---|
| 2,108,775 | 2/1938 | Macgeorge | 335/256 |
| 4,529,953 | 7/1985 | Myers | 335/126 |
| 4,959,627 | 9/1990 | Iizumi et al. | 335/106 |

*Primary Examiner*—Lincoln Donovan
*Attorney, Agent, or Firm*—Hill, Steadman & Simpson

[57] ABSTRACT

A relay having two coils which are arranged axially flush on a base body (1), wherein each coil has a winding (23, 33) and a core (14, 15) connected by means of a U-shaped yoke (12). A single armature (13) is supported on a center section of the yoke (12) such that it can be changed over between the inner ends of the two cores (14, 15). In addition, two contact springs (7, 8) are arranged between the two cores, on both sides of the same, parallel to the armature. The contact-making ends of the two contact springs rest on a common center contact element (61) in the quiescent state. Depending on which winding (23 or 33) is energized, a corresponding contact spring (7 or 8 respectively) is lifted off the center, contact element (61) and moved into contact with an outer contact element (51 or 52 respectively). The relay is advantageously suited as a pole-reversal relay for driving DC motors having a changing rotation direction (e.g., as found in motor vehicles)

29 Claims, 10 Drawing Sheets

ELECTROMAGNETIC CHANGEOVER RELAY

BACKGROUND OF THE INVENTION

1. Field of the Invention

The invention relates to an electromagnetic changeover relay which has two coils, which can be driven separately, on an insulating base body, for changing over at least one contact unit. The invention preferably relates to a pole-reversal relay for driving electrical drives having a reversible rotation direction, for example DC motors for clockwise and anticlockwise running, as are used in motor vehicles.

2. Description of the Prior Art

A pole-reversal relay, in addition to the use of two separate relays, is already known (DE 38 43 359 C2) for the said application, in the case of changeover relay, two complete relay blocks are arranged with point symmetry on a common base body. The contact elements which belong to the respective relay blocks and are operated by the two armatures are located between the relay blocks and are allocated to both systems, at least partially via fixed connections. Since this known system in each case has a dedicated coil former, a dedicated yoke and a dedicated armature for each of the two relay blocks, which are all accommodated on the base body, this results in a correspondingly high component cost which in turn results not only in an increased production and assembly cost but also an increased volume of the relay system.

In addition, a polarized miniature relay having two series-connected windings is also already known from DE 31 24 412 C1, in the case of such a miniature relay, a single armature is arranged and can be changed over in the center between two coil cores. Apart from the fact that this relay requires a permanent-magnet system, it is unsuitable for the abovementioned applications since the armature, which itself is used as the contact element, can neither switch large currents nor permits the number of contact combinations which are required, for example, for motor pole reversal.

A switching relay for transmission technology and electronics is known from DE-B-1,036,914. In such a case a switching relay, two magnet coils, which are aligned with their core axes with respect to one another, are arranged on a base plate and between whose mutually facing inner core ends an armature can be changed over. However, in this case, this armature is supported a long distance outside the coil region and carries contact elements on the ends facing away from the coils. In addition, the armature operates further contact springs, which are arranged outside the coil region, via a lever device. The entire construction of the relay described in this case is, however, very complicated and voluminous for present conditions, so that this design is not suitable for use in a motor vehicle.

SUMMARY OF THE INVENTION

It is an object of the invention to create an electromagnetic changeover relay which can preferably be used as a pole-reversal relay and permits a compact construction with a small number of simple parts.

According to the invention, this aim is achieved with a relay which has the following features:

an insulating base body;

two coils each having a winding and a core that can be driven separately are displaced on the base body. The winding and core are aligned essentially axially with respect to one another, forming an air gap between the mutually facing inner core ends;

a yoke connecting the outer core ends;

at least one armature displaced in the air gap between the inner core ends is supported on a central region of the yoke;

at least two contact springs which are each displaced between the armature and coil and mounted in the vicinity of the armature supporting point, and whose free, contact-making ends can each be changed over, by the armature or one of the armatures, between a quiescent position and an operating position; and at least two stationary, mating contact elements which are anchored in the base body and each make contact with at least one contact spring in at least one of their switching positions.

The relay according to the invention thus has only a single yoke which connects the outer eDds of the coil cores and it also requires—in the case of a preferred embodiment—only a single armature which can be changed over between the inner core ends. This armature operates contact springs which are displaced in the region between the armature and core, overlapping of the contact springs with the respective coil core being prevented, of course, by suitable design of the cross section. Particularly simple production using particularly few parts results when the two coil formers for holding the windings are integrally formed on the base body itself, so that both windings can also be fitted to the base body in one operation. In consequence, subsequent alignment of the two systems with respect to one another is also unnecessary.

The mating contact elements, which are expediently accommodated in a contact chamber which is constructed from the base body between the two coils, can be of different design for different applications. In one preferred embodiment for use as a motor pole-reversal relay both contact springs, which are each mounted on a retaining pin of the base body, rest on a common central contact element in the quiescent state, while if one or the other coil system is energized via the armature, the one contact spring or the other is optionally connected to one of two outer contact elements. It is being possible for these outer contact elements to be connected, in turn, to one another and to be provided with a common connecting pin. However, it would also be possible to provide separate mating contact elements in each case for both contact springs, so that two insulated changeover contacts are formed.

In one preferred embodiment, the contact springs themselves can be mounted in a force-fitting manner by plugging onto their associated retaining pins, which are provided with connecting pins, support on the base body for the purpose of prestressing being possible via projections. However, it is also possible for the contact springs to be mounted directly on the armature via insulating intermediate layers and for them to be connected to corresponding connecting pins, via flexible supply leads. It is also conceivable for the two contact springs to be electrically connected in order to create a bridge contact.

The arrangement, which is described above, of a retaining pin for a contact spring in the region between the armature and coil can influence the operation of the relay to the extent that a current loop, which passes through the iron circuit comprising the core, yoke and armature, can be formed via the contact spring, using a retaining pin which is used as a connecting pin, and the mating contact element when the contact is closed. The magnetic field of this current loop is superimposed on the energizing flux circuit of the coil. Depending on the flux direction in this current loop, the magnetic flux which is additionally produced can be directed in the same direction as the energizing flux or in the opposite direction and can thus increase or weaken the pulling-in force onto the armature. However, a problem can occur when a very high load current is flowing via a normally-open contact when the armature is pulled in, and the magnetic field of this load current holds the armature firmly in the pulled-in state even when the excitation is disconnected. The armature can thus no longer drop out. In the case of a changeover relay having two series-connected coils, an interposed armature and connecting pins of contact springs on each side of the armature, compensation can be carried out by selecting the polarity of the load terminals, utmost, in one direction so that the said problem can occur at extremely high switching currents. For this reason, a further design refinement of the relay construction according to the invention is intended to create the capability for it to be possible to switch off the loop effect of the retaining pin which is arranged between the armature, yoke and core, at least for specific applications having high switching currents.

For a relay according to the invention, having retaining pins for the contact springs in the region of the armature support, an advantageous solution of the stated problem is achieved by anchoring the connecting pins of both contact springs in the base body in the region between the armature and the one coil. The one connecting pin is used as a retaining pin for the one contact spring, and the other is connected to the other contact spring by means of a bracket section which engages over the armature. This other contact spring accordingly has a retaining pin which is not used as a connecting pin, or at least does not need to be used as such.

However, in an advantageous refinement, it is possible to construct the retaining pin of the other contact spring as a connecting pin. Thus, this further connecting pin can also be made use of instead of the opposite connecting pin or in addition thereto, for carrying the load current. Thus, for applications in which the loop effect is desirable, the retaining pin of each of the two contact springs can be used as a connecting pin. On the other hand, if it is desirable for the loop effect to be only partially effective, then the retaining pin of this other contact spring can be connected in parallel with the separate connecting pin which is connected to it, so that half of the load current flows through each of the two pins. The loop effect is then likewise only approximately half the loop current effect when the full load current is carried via the relevant supporting pin.

In a preferred refinement, a U-shaped connecting bracket is mounted by means of both ends in the base body, engaging over the armature, a first limb forming the connecting pin and a second limb forming a retaining pin for the contact spring which is connected to the connecting pin. This U-shaped connecting bracket is expediently mounted in the base body such that it can be plugged in, while the separate connecting pin and retaining pin of the first contact spring can be embedded in the base body.

A further possibility for preventing an undesirable loop effect through the connections of the load current is for the retaining pins, which are anchored in the base body between the core, armature and yoke, of the contact springs to be passed by means of their integrally formed connecting pins to the underneath or connecting plane of the relay, to be precise in the same way as the connecting pins of the mating contact elements, such that, however, the contact springs themselves in each case run underneath the core, that is to say between the core and the connecting plane of the relay. In this case, the load current always runs on one side of the magnetic circuit and does not dissect said circuit in the form of a magnetically acting loop.

The undesirable effect of a current loop in the magnetic circuit of the relay through the parts which carry the load current can also be prevented by means of a refinement in the case of which the side limbs of the U-shaped yoke are at right angles to the base plane and said U-shaped yoke is located with its center section parallel to the base plane, above the two coils, the armature being arranged in the air gap between the inner core ends, approximately at right angles to the base plane. This relay preferably has at least two contact springs, which are each arranged between the armature and one of the coils and are curved in the shape of a hairpin in the vicinity of the armature supporting point, of which one connecting limb is anchored in the base body and forms a connecting pin at right angles to the base plane, and the second limb can be changed over by means of the armature, between a quiescent position and an operating position.

In this case, the connecting pins which are described below ensure that no current loop passing through the magnetic circuit of the relay is formed via the contact springs which carry the load current and connections of said contact springs. In consequence, the load current is also prevented from magnetically influencing the armature.

The curved region of the contact springs, which are bent in the shape of a hairpin, can touch retaining pins which, for their part, are mounted in the base body but are not used as connecting pins. However, it is also possible to manage without such retaining pins. In this case, the respective contact spring is mounted, by clamping, by means of its connecting limb in a slot in the base body. Furthermore, it is expedient to fold the connecting limb at least in the section which forms the connecting pin and possibly also in the section which is used for clamping, in order to double the cross section in these regions.

BRIEF DESCRIPTION OF THE DRAWINGS

The invention is explained in more detail in the following text using exemplary embodiments and with reference to the drawings, in which.

DESCRIPTION OF THE PREFERRED EMBODIMENTS

Figure 1:
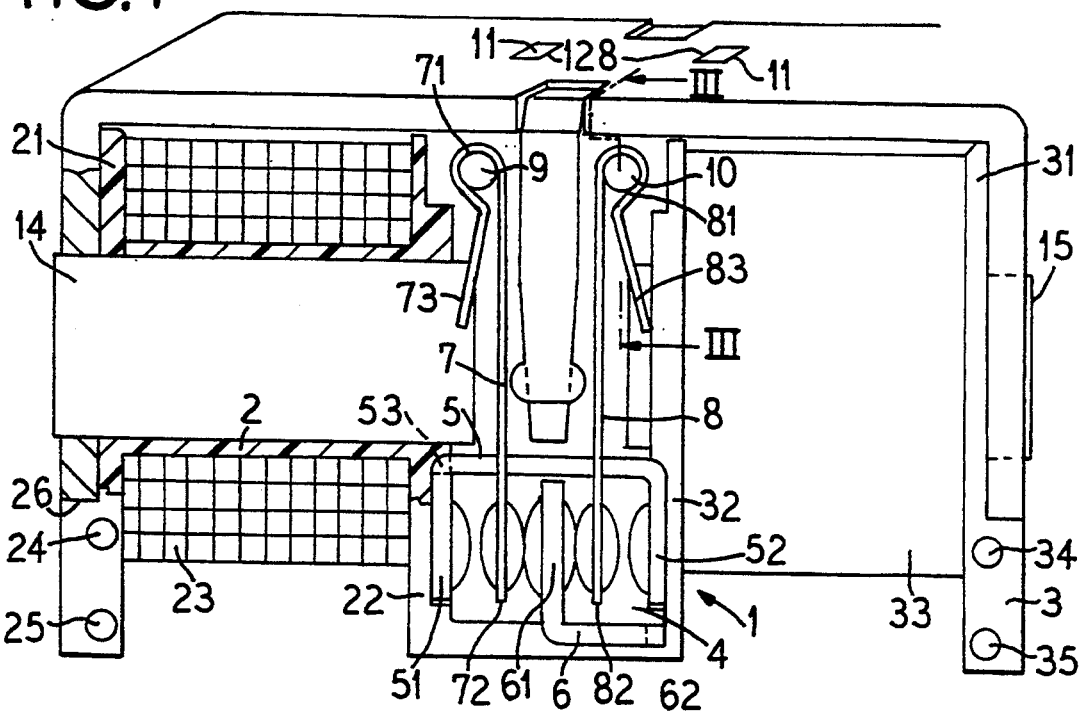
FIG. 1 shows a relay of the invention, having an armature, in plan view, partially cut away and the contour of whose yoke is partially indicated in a perspective manner.
Figure 3:
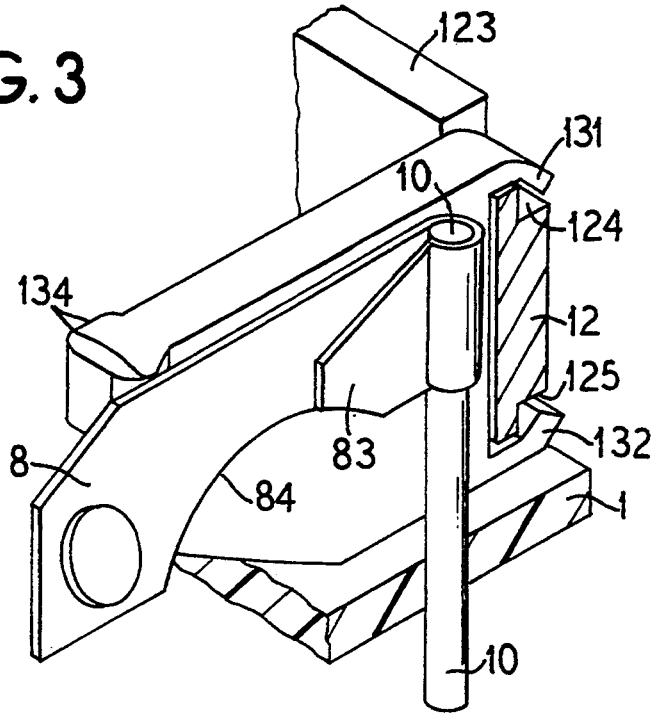
FIG. 3 shows a detailed view of the armature of FIG. 1 having a contact spring, in a perspective sectional view.

The relay which is shown in FIGS. 1 to 4 has a base body 1 which has two integrally connected coil formers 2 and 3 and a contact space 4 which is formed between the two coil formers. A winding 23 is fitted on the coil former 2 between two flanges 21 and 22, and a winding 33 is fitted on the coil former 3 between flanges 31 and 32. Two connecting pins 24 and 25 for the winding 23 are embedded in the coil flange 21, and two connecting pins 34 and 35 for the winding 33 are embedded in the coil flange 31. In this way, the two windings can be separately driven and energized. Since the two coil formers are integral parts of the base body, the two windings can be produced in one operation on a winding machine.

A U-shaped contact plate 5 plugs into the contact chamber 4, wherein a one piece contact plate 5 forms two outer contact elements 51 and 52 and passes through the base of the base body, with a connecting pin 53. A further contact plate 6 forms a center contact element 61 and a connecting pin 62 which passes through the base of the base body. The outer contact elements 51 and 52 are each provided with a contact piece, and the center contact element 61 is provided with two contact pieces. Furthermore, two contact springs 7 and 8, which are composed of leaf-spring material, are displaced in the contact chamber 4. Each contact spring is bent at a mounting end to form a clamping sleeve 71 or 81 respectively and is plugged by means of this clamping sleeve onto a retaining pin 9 or 10, using an extension which is used as a connecting pin 9*a* or 10*a*. In an opposite manner to the mounting ends, the contact springs each form contact-making ends 72 and 82, which are each provided with contact pieces on both sides and can be changed over between the center contact element 61 and one mating contact element 51 or 52.

Both contact springs 7 and 8 are prestressed towards the center contact element 61 as a result of the force-fitting mounting by means of the clamping sleeves 71 and 81. No rotation on the retaining pins 9 and 10 takes place even during a switching movement of the contact springs. However, in some cases it could be necessary to mount the contact springs on the retaining pins using additional means, such as soldering or welding. In this case, the mounting end of the springs could also be formed differently. In addition, at their connecting end, the contact springs 7 and 8 each have a projection 73 or 83, which is supported on the base body, specifically on the respective coil flange 22 or 32, and hence causes the said prestressing of the contact springs towards the center contact element 61. The prestressing of the contact springs using this projection can be produced during assembly in every case, even when the springs are intended to be fixed to the connecting pin subsequently, by welding or the like. As can be seen from FIG. 3, the contact springs 7 and 8 each have a circular cut-out, for example 84, in their center section. The cut-out is matched to the curvature of the associated coil core and permits free movement of the contact spring above the coil core.

Figure 2:
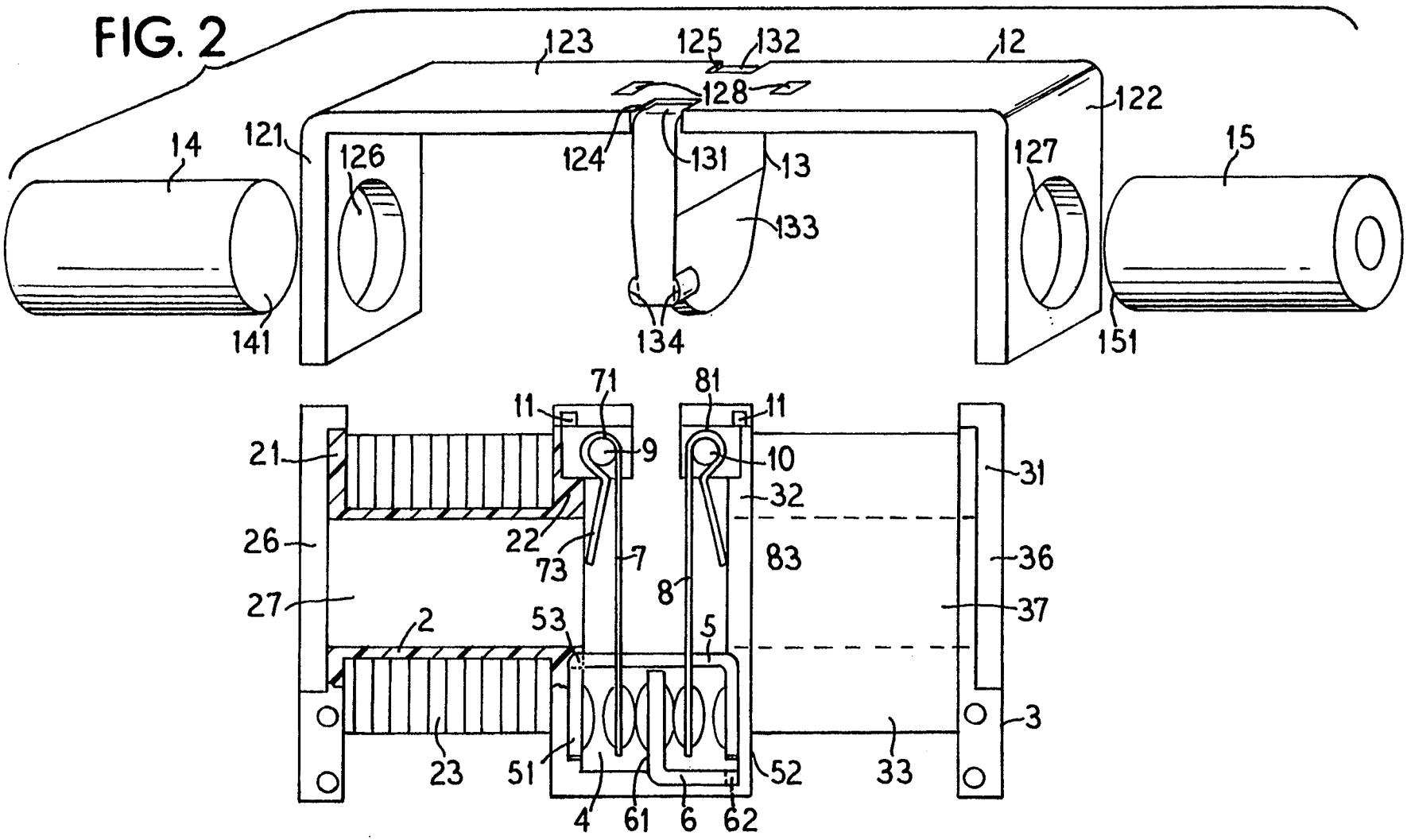
FIG. 2 shows a representation of the components of the relay of FIG. 1 before assembly, the base body with the windings and the contacts once again being shown in plan view and the yoke with the armature and cores being shown in a perspective view.

A yoke-armature assembly, shown in perspective in FIG. 2 before assembly, is placed on the coil former having windings and contact elements. A yoke 12, having two side sections 121 and 122 and an elongated center section 123, plugs onto the two outer coil flanges 21 and 31. An armature 13 which, at its supporting end has retaining flaps 131 and 132 in an extension of its side edges, is supported on the yoke 12, in advance. These retaining flaps are in each case bent into supporting notches 124 and 125 respectively during the assembly of the armature on the yoke center section 123, and thus prevent the armature from falling out. The mobility of the armature in its support is ensured by deliberate deflection of the armature to both sides over a range which is greater than the subsequent switching movement.

Figure 8:
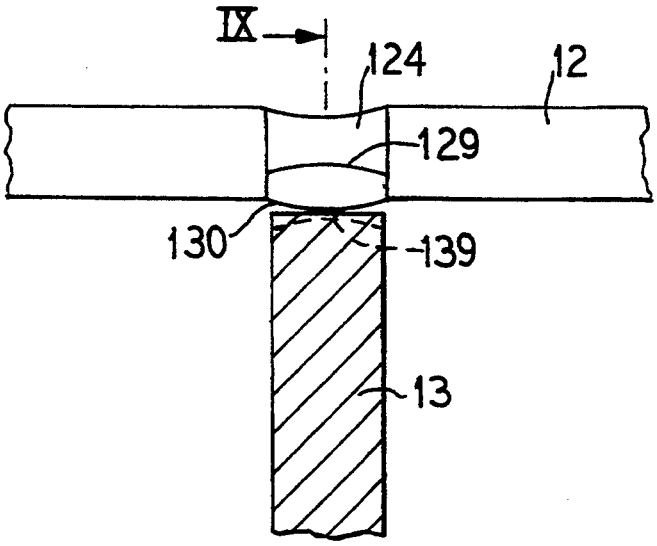
FIGS. 8 and 9 show a detail of the armature support of the relay according to FIGS. 1 to 5, in two sectional views.
Figure 9:
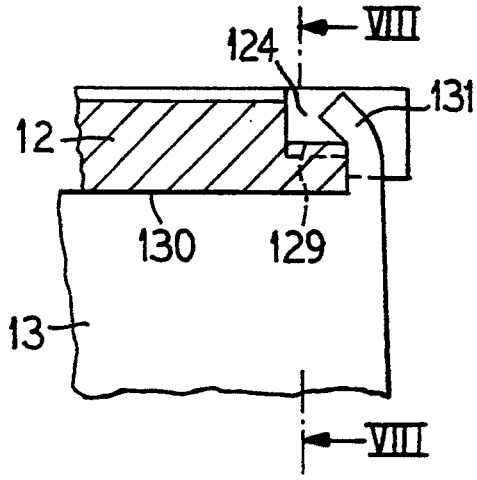

The support of the armature is expediently designed as shown in the two detailed sections in FIGS. 8 and 9. In this case, the inner wall 129 of the supporting notch 124, on which the retaining flap 131 rolls, is stamped in a spherical manner. In addition, in the case of the exemplary embodiment, the yoke section 130 which faces the armature is also stamped in a spherical manner so that the armature can roll thereon with its supporting edge. This section 130 can be stamped in such a manner entirely or partially over the width of the yoke. In addition, or as an alternative thereto, the armature can also be stamped in a spherical manner on its end 139 facing the yoke.

After assembly of the armature, the yoke 12 is plugged onto the base body so that the side limbs 121 and 122 engage in corresponding recesses 26 and 36 respectively of the flanges 21 and 31 respectively, and the armature projects into the contact space. In order to increase the position stability of the contact chamber, centering pins 11 are also integrally formed on the base body. The centering pins engage in perforations 128 during the installation of the yoke 12. Thereafter, two cores 14 and 15 are pressed in from the outer sides through recesses 126 and 127 respectively in the yoke side limbs 121 and 122, into axial recesses 27 and 37 respectively in the two coil formers, and connect to the yoke by means of a push fit or in another way, for example clipping or welding. At the same time, the operating air gap with respect to the two armature surfaces is set up by pushing the cores 14 and 15 in, in a dimensionally accurate manner. In this case, the armature 13 has an incline 133 on its side surfaces so that it is parallel to the inner pole surface 141 or 151 respectively of the respective core during switching. However, instead of the inclines 133 on the armature, an alternative has somewhat oblique core pole surfaces 141 and 151 or arranges the coils, with the respective cores, in a slightly oblique manner with respect to one another.

In addition, switching cams 134 are integrally formed on both sides on the armature, and are used for operating contact springs 7 and 8. In the present example, the thickness of the armature between the two switching cams is selected to be so small that the armature is located in a decoupled manner, with play, between the two contact springs 7 and 8 when the latter are both resting with their contact-making ends 72 and 82 on the center contact element 61. However, as a result of a thicker armature and corresponding spring prestressing, it would also be possible to allow only one contact spring to rest on the center contact element in the quiescent state and thus, for example, to create a sequence contact.

The function of the relay results directly from the structural design. In the quiescent state, both contact springs 7 and 8 rest with their contact-making ends 72 and 82 on the center contact element 61. Depending on whether a winding 23 or 33 is energized, the armature is pulled onto the associated core 14 or 15, bringing the associated contact spring 7 or 8 into contact with the corresponding outer contact element 51 or 52. In this case, the other contact spring in each case remains on the center contact element 61. When changing over from one coil to the other, the armature passes through a center position in which both contact springs 7 and 8 simultaneously make contact with the center contact element 61 before the other contact spring is then connected to the associated outer contact element 52 or 51. If none of the windings is energized, the armature remains in the center position, and the contact springs 7 and 8 rest on the center contact element 61 by means of their prestressing.

Figure 4:
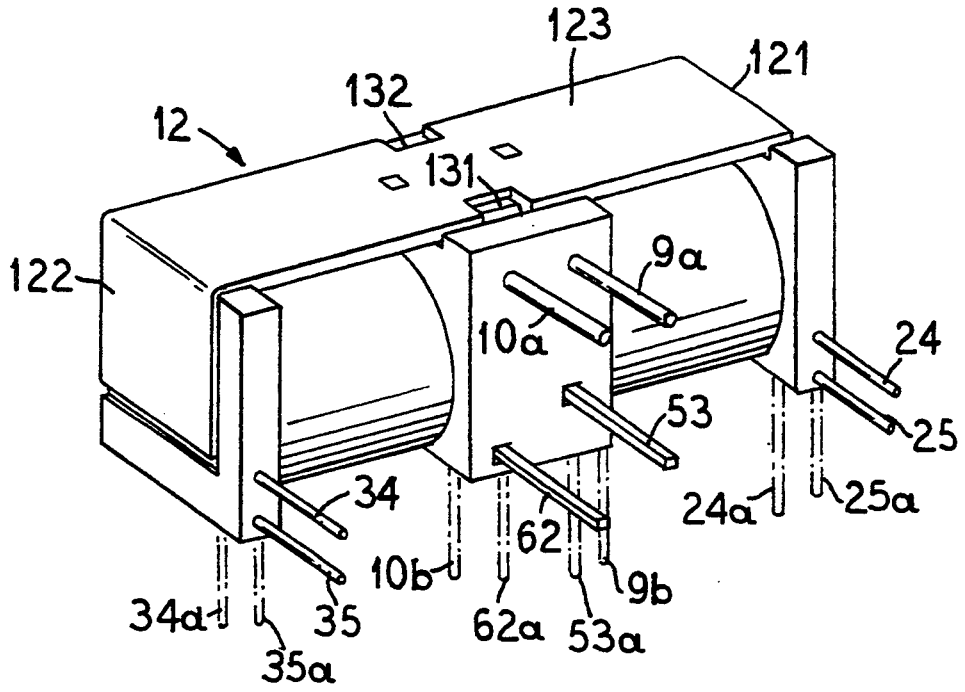
FIG. 4 shows a perspective view of the mounted relay, seen from the connecting side.
Figure 5:
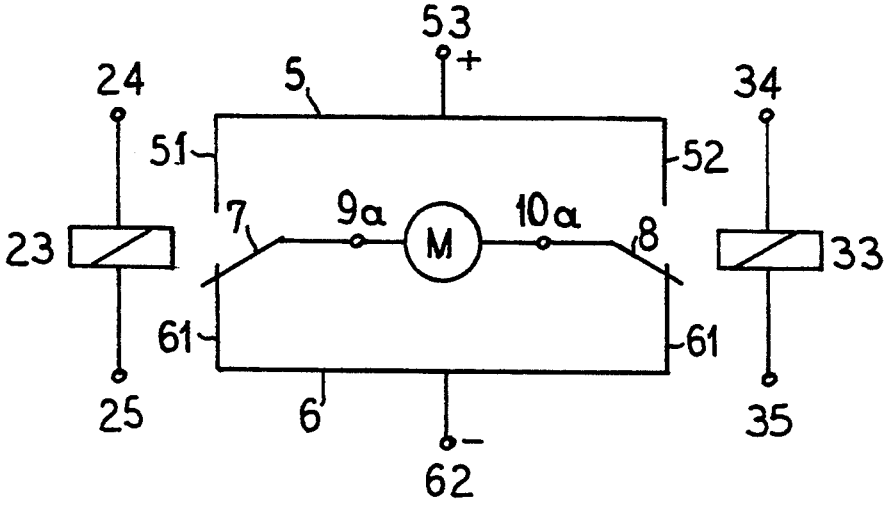
FIG. 5 shows a circuit diagram for using the relay of the invention with a motor.

FIG. 5 shows a preferred circuit diagram for use as a pole-reversal relay for driving a DC motor M, the connections and the contact elements being designated in the same way as in the FIGS. 1 to 4. The DC motor M is coupled to the connecting pins 9*a* and 10*a* of the contact springs. The connecting pins 53 and 62 of the mating contact elements 5 and 6 are connected to a power source (+ and − respectively). When one of the windings 23 or 33 is energized, a switching cam of the armature operates one of the contact springs 7 or 8, the DC motor M being connected by means of the operated contact spring to the second terminal of the power source, via the normally-open mating contact element 5, so that the motor runs in one of the rotation directions, depending on the polarity.

When the excitation is switched off, both contact springs are connected to the normally-closed mating contact element 6 and short-circuit the motor. In consequence, after the disconnection process, the motor is rapidly braked via the generator current, with the advantage that the motor runs on only slightly and the desired position, for example on actuating functions is largely maintained. The reversal of the motor rotation direction is achieved by means of the alternate excitation of the two windings 23 and 33 respectively. Since the connection pins 25, 35 and 62 in the case of the preferred application in a motor vehicle are connected to the same (earth) potential, they can also already be structurally short-circuited to one another in the relay. This is particularly simple in the case of the design shown, since the three pins are already located on a line.

The design according to FIGS. 1 to 4 is selected such that the main planes of the yoke are at right angles to the connecting plane and said yoke laterally encloses the relay on three sides. However, it would also be conceivable to rotate the relay, with its installation plane, through 90° about the coil axis, so that the yoke would come to rest with its center section above the coils and the contact space, with respect to the installation plane. In FIG. 4, the connecting pins are shown by dashed lines for such an installation position, that is to say the connecting pins 9*b*, 10*b*, 62*a* and 53*a* for the contact elements and the coil connecting pins 24*a*, 25*a*, 34*a* and 35*a*. In each case, the relay is provided with a housing cap, which is not shown, and is sealed on its underside, for example in a conventional manner by means of a base plate whose open gaps are potted.

Figure 6:
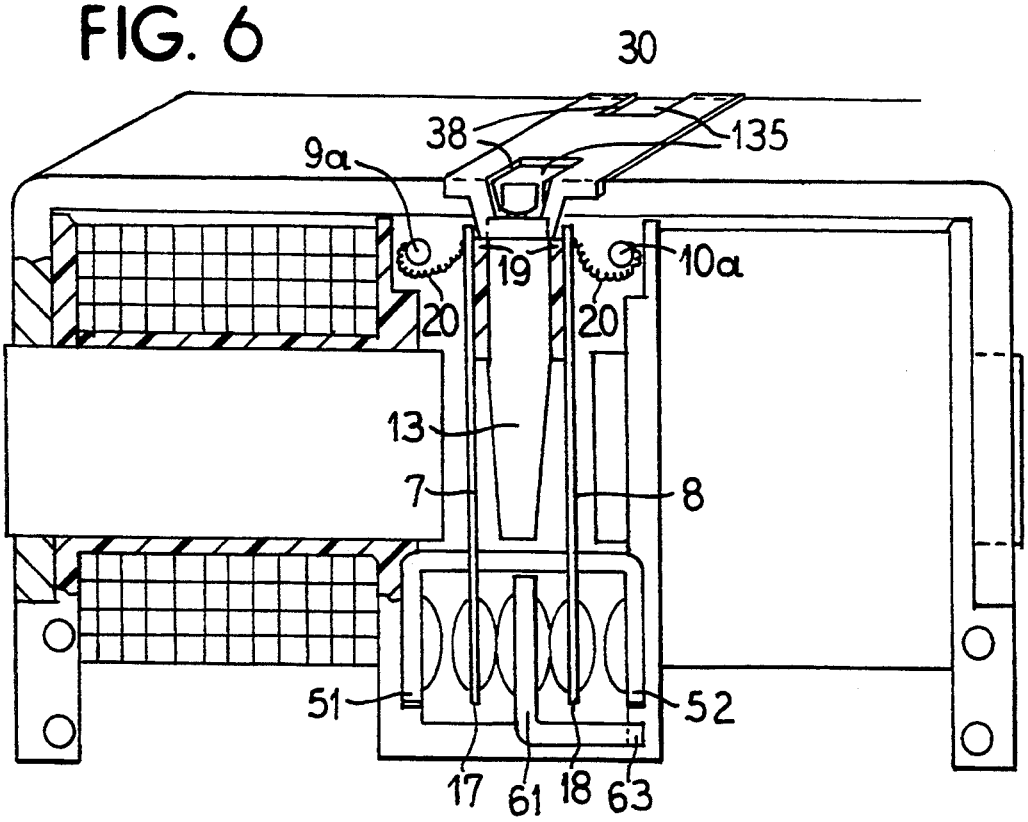
FIG. 6 shows a view corresponding to FIG. 1, with a modified design of the armature and of the contact springs.

A modified embodiment of the contact system is shown in FIG. 6, in a view which corresponds to FIG. 1. In this case, contact springs 17 and 18 each firmly connects to the armature, in the vicinity of its supporting point, via insulating intermediate layers 19. The contact springs are thus driven directly by the armature movement; the armature thus requires no switching cams as in the case of the preceding exemplary embodiment. The contact springs 17 and 18 connect to the associated connecting pin 9*a* or 10*a* via flexible connecting leads, for example via braided cables 20.

The firm connection of the contact springs to the armature according to FIG. 6 has the consequence that, during switching of the armature to one side, for example when the contact spring 18 is being changed over to the outer contact element 52, the other contact spring 17 is pressed against the center contact element 61 with an increased contact force. This can be advantageous for specific applications.

FIG. 6 shows a further modification with respect to FIG. 1 in the manner in which the armature is supported. In this case, the armature is held by a supporting plate 30 which surrounds the center section 123 in a U-shape. Supporting tabs 135 of the armature at the same time latch into corresponding recesses 38 in the supporting plate 30 and thus hold the armature. This type of armature support can be used irrespective of the type of contact spring mounting, even in the case of the exemplary embodiment in FIG. 1 or FIG. 7. The previously mentioned different installation positions can likewise be combined at will with the type of armature support and contact-spring mounting.

Figure 7:
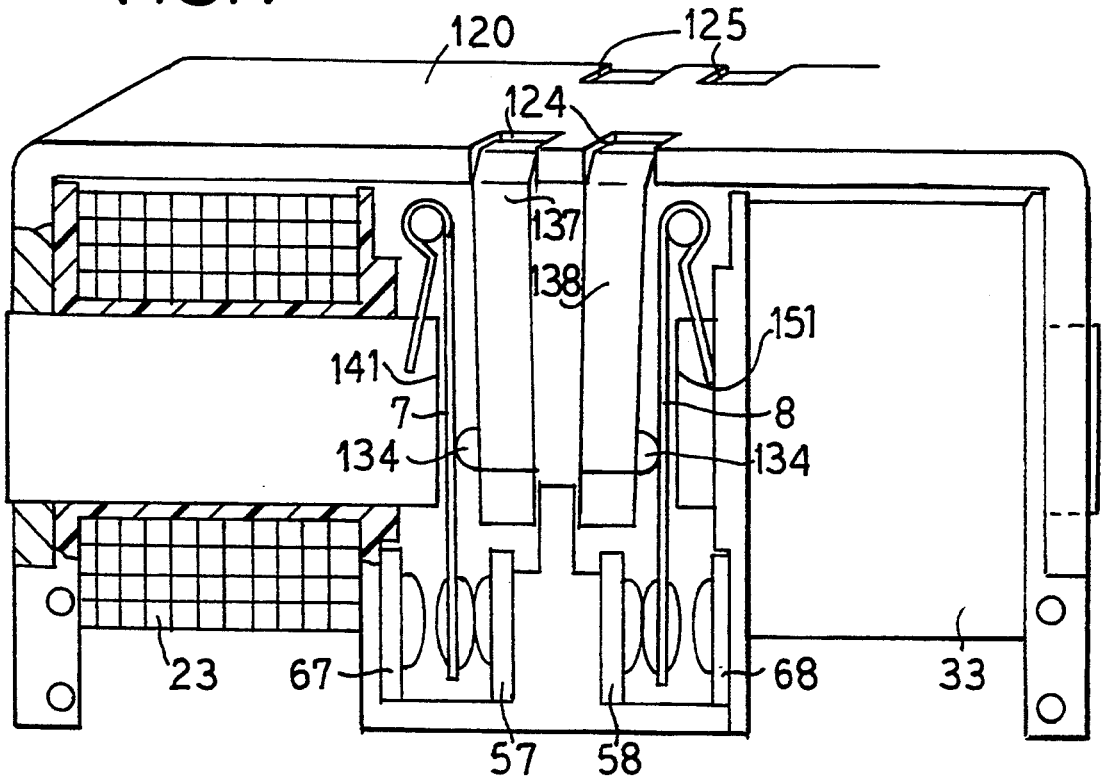
FIG. 7 shows a relay which is slightly modified from that in FIG. 1 and has two armatures.

In a further modification of FIG. 1, FIG. 7 shows an exemplary embodiment having two armatures 137 and 138 which are arranged between the two coil formers 2 and 3 and the windings 23 and 33 respectively, and are supported on a yoke 120. In the same way as the rest of the relay construction this yoke 120 largely corresponds to the design in FIG. 1; it merely has two pairs of supporting notches 124 and 125 for the two armatures, in which supporting notches 124 and 125 the two armatures are supported in the same way as in the first exemplary embodiment. However, armature supports in accordance with FIG. 6 would also be possible. The construction of the two armatures 137 and 138 themselves corresponds to the 10 armature 13. However, since each armature operates only one contact spring 7 or 8, each requires only one switching cam 134 on the side facing the contact spring. In order to prevent a short-circuit via the two armatures and the yoke for the two contact systems which are otherwise separate, at least one of the switching cams 134 must be composed of insulating material. In the exemplary embodiment shown in FIG. 7, each armature independently operates a dedicated changeover contact having one inner contact element 57 or 58 and one outer contact element 67 or 68. Other contact configurations would, of course, also be conceivable in this case.

Further, in the embodiments, the retaining pins and connecting pins for the contact springs and for the coil windings are injection-molded in the base body and are thus already positioned correctly without any additional cost.

Figure 10:
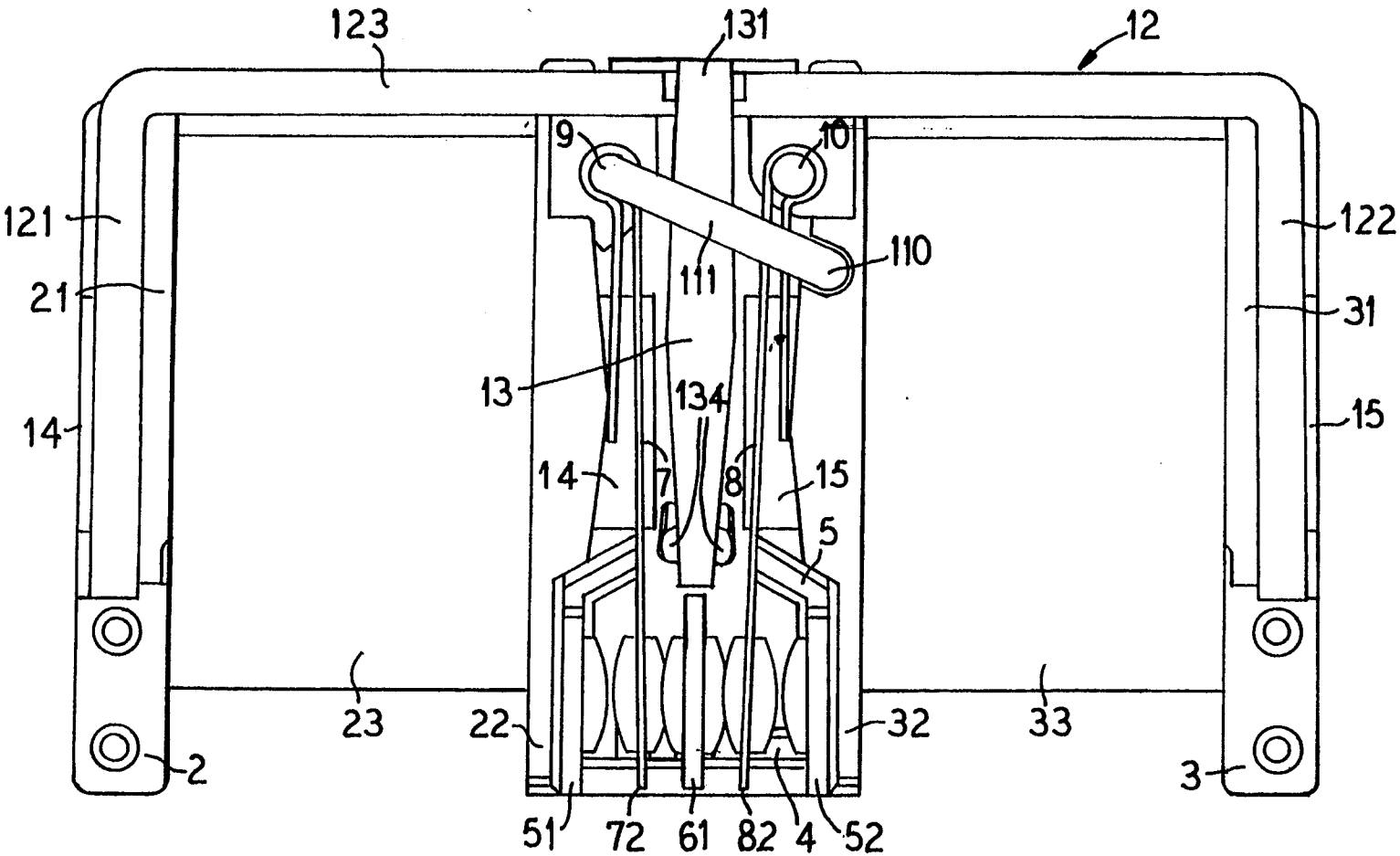
FIG. 10 shows another embodiment of the change-over relay in plan view, the effect of the current loop optionally being prevented.
Figure 11:
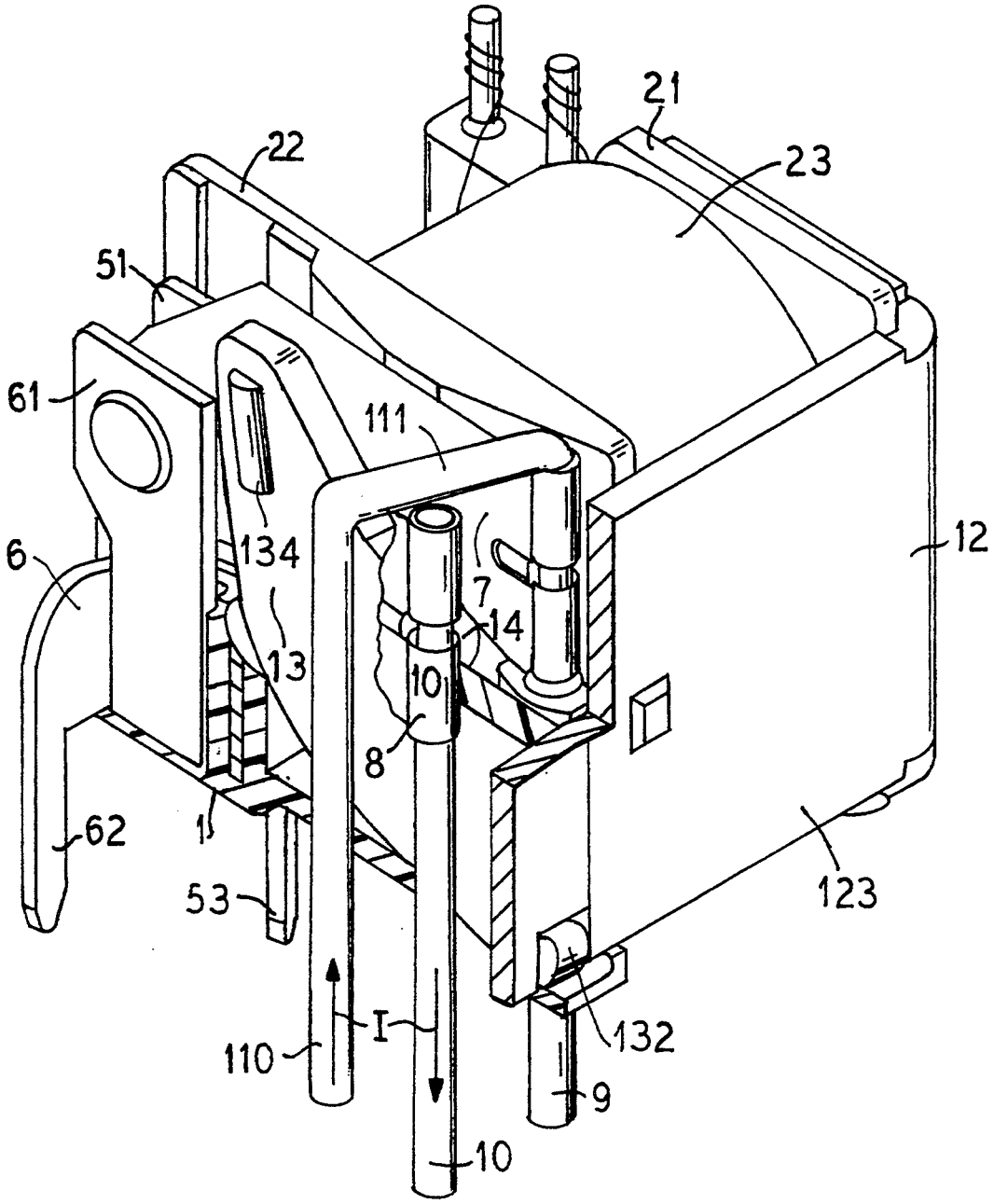
FIG. 11 shows a perspective view of a relay according to FIG. 10, sectioned approximately in the center, in the region of the armature.

The relay shown in FIGS. 10 and 11 has a largely similar construction to the relay in FIG. 1, wherein identical reference symbols designate identical parts; to this extent, a substantive description is superfluous.

If, of the relay, the two retaining pins 9 and 10 are now in each case also used as connecting pins for the two contact springs in such a manner that the switching current flows via one retaining pin or the other, an additional magnetic field can thus be produced. In the case of very high switching currents, the additional magnetic field is formed through the current loop in the iron circuit of the core, yoke and armature. The additional magnetic field maybe of such intensity that, under some circumstances, the armature in the relevant circuit will no longer fall out even after the excitation has been disconnected. For this reason, an additional connecting pin 110 is provided in the region between the armature 13 and the coil winding 33, which additional connecting pin 110 engages over the armature via a bracket section 111 and is connected to the retaining pin 9 of the contact spring 7. In the design shown, the connecting pin 110 with the bracket section 111 and the retaining pin 9 forms a U-shaped connecting bracket, which plugs into the base body. However, it would also be conceivable to mount a connecting pin 110 and a retaining pin 9 in the base body by embedding it in the same way as the retaining and connecting pin 10 and **10*a* bending a bracket section 111** over the armature and to welding it or otherwise mounting it on the respective opposite part.

In this arrangement having both connections in the region of the one coil, compensation for the load-loop effect takes place on this side, while the magnetic circuit of the other coil is free of a load loop.

When the relay is used as a pole-reversal relay, the switching current I flows in the opposite direction in the two contact springs and in their connecting pins. Since the two connecting pins **10*a* and 110 now lie on one side of the armature in the iron circuit of the winding 33, their respective current-loop effect is essentially cancelled out while no current-loop effect is produced in the iron circuit of the winding 23 as long as the retaining pin 9 does not carry the switching current. However, if it is intended to produce a current-loop effect deliberately, then the retaining pin 9 can also be used as a connecting pin, instead of the pin 110.. It is conceivable, in particular, for both connecting pins 9 and 110** to be connected in parallel outside the relay and thus each to carry half the switching current via each of the pins. This current distribution results in a loop effect of approximately 50% of the full loop effect which can be advantageous in specific load cases, for example in the case of a lamp load.

Figure 12:
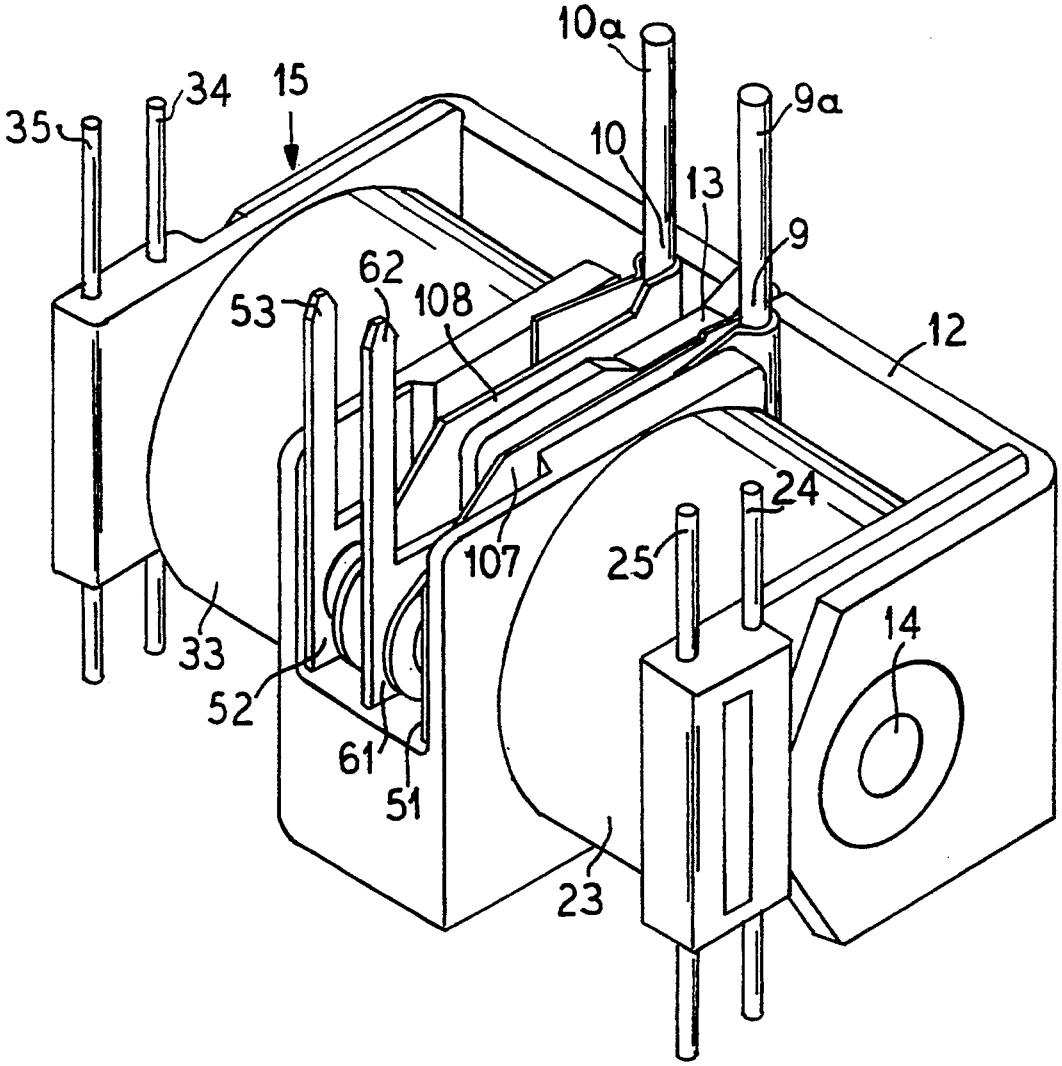
FIG. 12 shows a further embodiment of the relay, in perspective view, from the underneath.

The relay which is shown in FIG. 12 once again has a construction which is identical in principle to that in FIG. 1, with a base body 1 which carries the windings 23 and 33 with their connecting pins 24, 25 and 34, 35, as well as the yoke 12 and the armature 13. As the view of the relay from underneath onto the connecting side shows, only one contact space 104 in the lower region of the base body 1 is designed such that it is open to the underneath. The mating contact elements 52 and 61, with their connecting pins 53 and 62, are inserted into the base body from below. In addition, contact springs 107 and 108 are designed such that they can be plugged onto the retaining pins 9 and 10, with the connecting pins **9*a* and 10*a* respectively, from below. The contact springs thus extend underneath the coil cores 14 and 15 so that the magnetic circuit does not pass through the load circuit, from the connecting pins 9*a* and 10*a*, via the contact spring 107 and 108, to the mating contact elements 51, 52 and 61**.

The relays which are shown in FIGS. 13 to 16 in each case once again have a construction similar to FIG. 1, identical reference symbols being allocated to identical parts.

Figure 15:
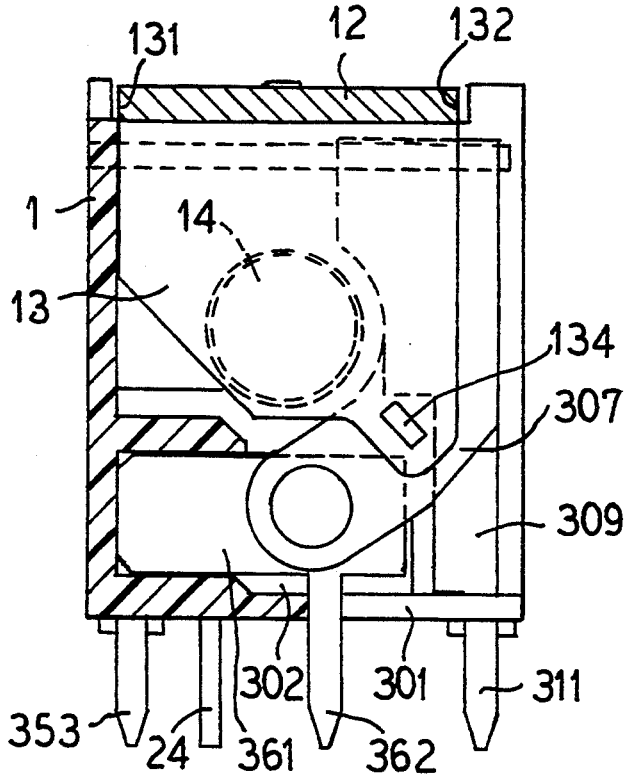
FIG. 15 shows a section XV—XV through the relay of FIG. 13.
Figure 16:
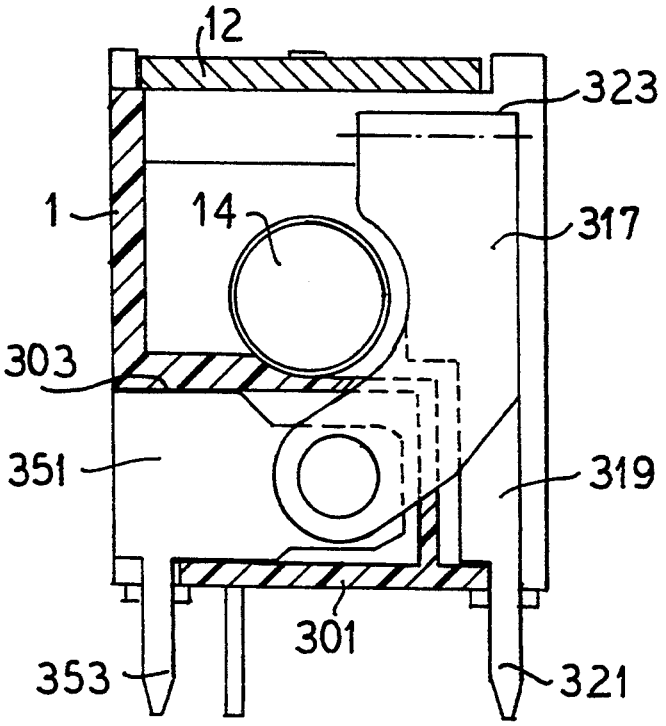
FIG. 16 shows a section XVI—XVI in the relay of FIG. 14.

Two self-supporting outer contact elements 351 and 352 and a center contact element 361 are mounted in the contact space 4, whose base 301 which is formed by the base body 1 defines the base plane of the relay, their associated connecting pins 353 and 362 respectively passing through the base 301 at right angles to the base plane. As can be seen in FIGS. 15 and 16, the center contact element 361 is inserted from the front side, which is visible in FIG. 13, into a slot 302 in the base body, while the outer contact element 351 is in each case inserted into a corresponding base body slot 303, from the opposite rear side, in the same way as the outer contact element 352, which is not visible in FIG. 16. The two outer contact elements 351 and 352 could also be connected to form a common mating contact element, and be provided with a single connecting pin.

In addition, two contact springs 307 and 308 respectively, which can in each case be changed over between an outer contact element 351 or 352 and the center contact element 361, are displaced in the contact space 4 between the two coil flanges 22 and 32. These two contact springs 307 and 308 are bent in the shape of a hairpin and thus form a connecting limb 309 or 310, which runs approximately at right angles to the base plane and is then guided outwards, in a connecting pin 311 or 312. In the case of the exemplary embodiment according to FIG. 13, the bending section 313 or 314 of the contact springs is designed as a clamping sleeve and is fitted onto a retaining pin 315 or 316. These retaining pins are anchored in the base body, but are not constructed as connecting pins.

Figure 13:
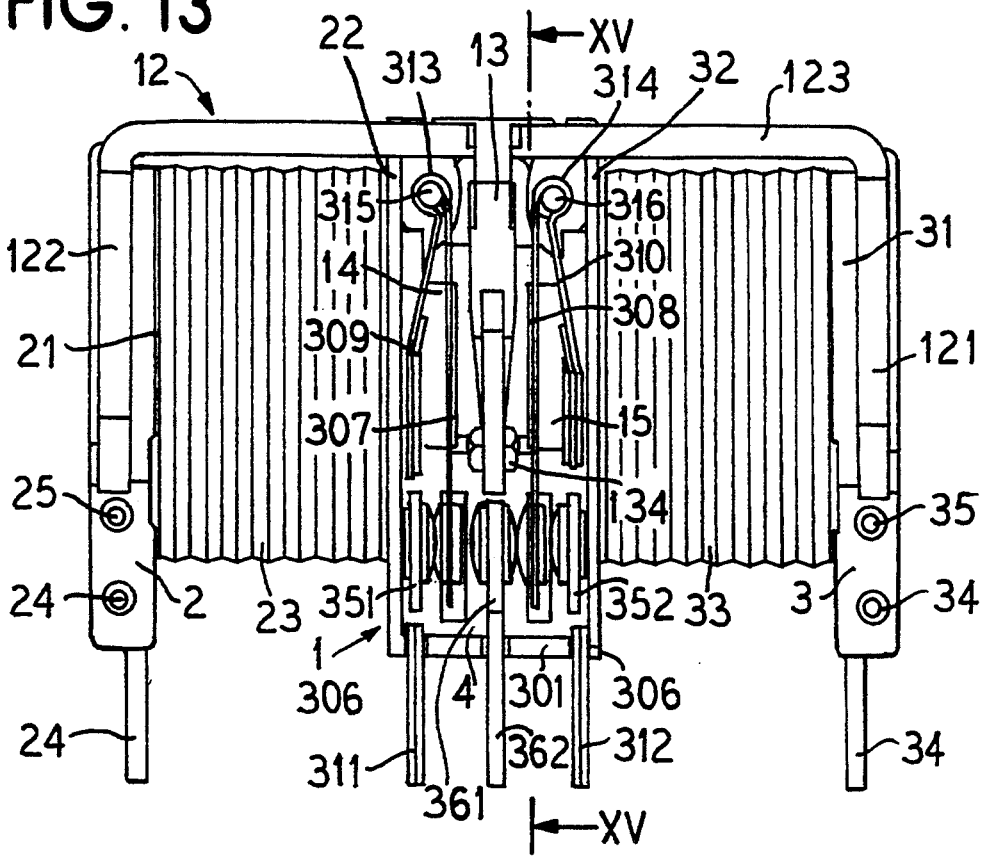
FIG. 13 shows a side view of a vertical embodiment of the relay, the contact springs being seated on retaining pins.
Figure 14:
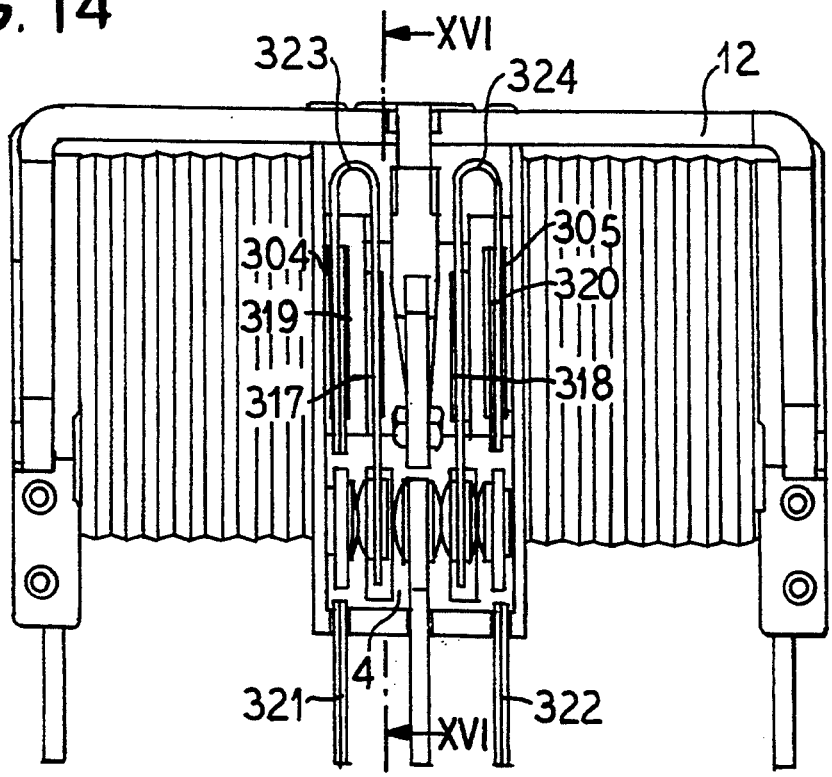
FIG. 14 shows a view corresponding to FIG. 13, in a modified embodiment without retaining pins.

In the case of the embodiment of FIG. 14, contact springs 317 and 318 are provided which are likewise bent in the shape of a hairpin and each form a connecting limb 319 or 320, having integrally formed connecting pins 321 and 322. In this case, the bending region 323 or 324 is of simpler construction, since there are no retaining pins. The contact springs 317 and 318 are in this case mounted by clamping into mounting slots 304 and 305 in the base body. In order to obtain a stable mounting, the connecting limbs 319 and 320 are in each case folded in the longitudinal direction or transversely, so that double the cross-section of the spring plate acts. The connecting limbs 309 and 310 in FIG. 13 are also folded; such a fold is highly expedient, at least in the region of the connecting pins 311 and 312, in order to achieve the desired robustness.

The contact springs are in each case shown broken-off in the region of the connecting limbs in FIGS. 13 and 14, in order to make the stationary contact elements located behind them visible. Otherwise, the shape of the contact springs can be seen from FIGS. 15 and 16. This also shows how the contour of the contact springs is matched to the coil core 14 or 15 respectively, in order not to affect adversely the air gap between the respective core and an armature 13 which is still to be described. In the case of the exemplary embodiments shown, the contact springs, with their connecting limbs, are in each case inserted into a lateral slot 306 from the front side, which is shown in FIG. 13 and FIG. 14. However, an embodiment in which the contact springs are inserted into corresponding perforations in the base 301 from above, at right angles to the base plane, in the same way as the stationary mating contact elements, would also be conceivable. The coil connecting pins 24 and 25 as well as 34 and 35 are embedded in a coil flange 2 or 3 and are bent at right angles to the base plane on the rear side, which is not visible, of FIG. 13 or FIG. 2.

Since the contact springs which are each arranged between the armature and coil, with their associated connecting limb, are passed out at right angles downwards, they do not form a load-current loop which would pass through the iron circuit of the core, yoke and armature. This ensures that even a high load current does not adversely affect the pull-in behavior or the drop-out behavior of the armature. This also applies to the case in FIG. 13, where the retaining pins 315 and 316 are also anchored in the base body. This is because these retaining pins are used merely for holding the contact springs and have no connecting elements, so that they also carry no load current. Since the connecting pins 311 and 312 as well as 321 and 322 are integrally formed directly on the respective contact spring, a low-resistance current contact is also ensured from the contact springs to the respective connecting points in a conductor track.

We claim:

1. An electromagnetic changeover relay, comprising:
   an insulating base body;
   two coils, each having a winding and a core, on said base body, and having the capability of being driven separately are aligned essentially axially with respect to one another, forming an air gap between mutually facing inner core ends;
   a yoke connecting outer core ends;
   at least one armature displaced in said air gap between said inner core ends supported on a central region of said yoke;
   at least two contact springs arranged between said armature and coil and mounted in the vicinity of a armature supporting point, and whose free, contact-making ends can each be changed over, by said at least one armature, between a quiescent position and an operating position; and
   at least two stationary, mating contact elements anchored in said base body and making contact with at least one contact spring in at least one of their switching positions.

2. The relay as claimed in claim 1, wherein a single armature is provided between said two contact springs.

3. The relay as claimed in claim 1, wherein said mating contact elements comprise a center contact element displaced in front of said free armature end and two outer contact elements which are opposite said center contact element, having the capability to change over each contact spring, with its contact-making end, between said center contact element and one of said outer contact elements.

4. The relay as claimed in claim 1 wherein said mating contact elements comprise two separate inner contact elements displaced in front of the free anchor end and that two outer contact elements which are in each case opposite said inner contact elements having the capability to change over each contact spring, with its contact-making end, in each case between an inner contact element and an outer contact element.

5. The relay as claimed in claim 3, wherein, in the quiescent state, the armature is displaced in a decoupled manner between two contact springs which rest on said mating contact element.

6. The relay as claimed in claim 3, wherein said outer contact elements having at least one common connecting pin connect to one another.

7. The relay as claimed in claim 1, wherein said two armatures displaced between said two inner core ends parallel to one another, each operates one of the contact springs independently.

8. The relay as claimed in claim 1, wherein a switching cam connected to said armature operates said two contact springs mounted on a retaining pin anchored in said base body.

9. The relay as claimed in claim 8, wherein said contact springs, having a mounting end in the form of a clamping sleeve which form, a spring strip mount mounting end, in the form of a clamping sleeve, on said retaining pin.

10. The relay as claimed in claim 9, wherein said the contact springs are prestressed towards the associated armature via a projection which is integrally formed on said contact spring mounting end and is supported in the base body.

11. The relay as claimed in claim 1 wherein said contact springs.

12. The relay as claimed in claim 11, wherein said contact springs are electrically connected via a flexible supply lead to a connecting pin anchored in said base body.

13. The relay as claimed in claim 12 wherein said base body integrally forms two coil formers and forms a contact space between said coil formers on which windings are fitted and into which said cores are inserted.

14. The relay as claimed in claim 13, wherein said armature has external retaining flaps on its supporting end, wherein said retaining flaps are bent into supporting notches such that they surround a center section of said yoke on both sides.

15. The relay as claimed in claim 13, wherein said armature has external supporting elements, preferably latching tabs, on its supporting end, wherein said external supporting elements interlock with corresponding supporting elements, preferably recesses , in a supporting plate which engages around said yoke.

16. The relay as claimed in claim 15, wherein said U-shaped yoke having main planes, is displaced at right angles to the base plane of said relay, wherein said connecting elements for said contacts and coil winders are anchored in said base body parallel to the yoke planes.

17. The relay as claimed in claim 16, wherein said retaining pin for a contact spring being located inside the iron circuit formed by said yoke, armature and core, and said mating contact element being located with at least a connecting section outside this iron circuit, wherein a connecting pin for contact springs anchors in the base body beside said armature or said yoke opposite the contact spring, and is conductively connected to the contact spring via a bracket section which engages over the armature or yoke.

18. The relay as claimed in claim 17, wherein said connecting pins of two contact springs are anchors in said base body in region between said armature and one coil, wherein one connecting pin being used as a retaining pin for one contact spring and the other conductively connecting the other contact spring wherein a bracket section engages over said armature.

19. The relay as claimed in claim 18, wherein said retaining pin of the other contact spring is additionally constructed as a connecting pin.

20. The relay as claimed in claim 19, wherein a U-shaped connecting bracket having limbs at both ends mounts in said base body, such that it engages over said armature, wherein a first limb forms a connecting pin and a second limb forms a retaining pin for said contact spring.

21. The relay as claimed in claim 20, wherein said U-shaped connecting bracket mounts in the base body such that it can be plugged in.

22. The relay as claimed in claim 16, wherein said retaining pins arranged between said core, yoke and armature, for the contact springs pass underneath the relay, as connecting pins, in the same way as the connecting pins of the mating contact elements, and said contact springs mount in a region underneath of the relay and the coil core.

23. The relay as claimed in claim 15, wherein side limbs of said U-shaped yoke and said at least one armature are at right angles to the base plate of the relay, and a center section of said yoke lies parallel to the base plane of the relay, above the coils, having the connecting elements of the relay anchored in the base body at right angles to said center section of said yoke.

24. The relay as claimed in claim 23, wherein at least two contact springs are disposed between said armature and one of the coils and are curved in the shape of a hairpin in the vicinity of the armature supporting point, wherein contact springs having a connecting limb anchors in said base body and forms a connecting pin at right angles to the base plane, and wherein contact springs having a second limb can be changed over by said armature between a quiescent position and an operating position.

25. The relay as claimed in claim 24, wherein said contact springs having a curved region are supported by said curved region on a supporting pin mounted in said base body parallel to the base plane.

26. The relay as claimed in claim 25, wherein said connecting limb of each contact spring mounts in a slot of said base body, by clamping.

27. The relay as claimed in claim 24, wherein said connecting limb of one contact spring is folded, at least over a part of its length.

28. The relay as claimed in claim 26, wherein said connecting limbs of said contact springs and of said mating contact elements insert into laterally open plug-in slots (302, 303, 306), parallel to the base plane.

29. The relay as claimed in claim 26, wherein said connecting limbs of said contact springs or of said mating contact elements insert into laterally closed plug-in slots, at right angles to the base plane.

* * * * *